US009189979B2

(12) United States Patent
Gastelum et al.

(10) Patent No.: US 9,189,979 B2
(45) Date of Patent: Nov. 17, 2015

(54) DISPLAY SHIELD HAVING A COLLAPSIBLE HOLDER FOR A BEVERAGE

(71) Applicants: Branden Rodolfo Gastelum, San Pedro, CA (US); Rodolfo Gastelum, San Pedro, CA (US); Manuel Gastelum, Bonita, CA (US)

(72) Inventors: Branden Rodolfo Gastelum, San Pedro, CA (US); Rodolfo Gastelum, San Pedro, CA (US); Manuel Gastelum, Bonita, CA (US)

( * ) Notice: Subject to any disclaimer, the term of this patent is extended or adjusted under 35 U.S.C. 154(b) by 0 days.

(21) Appl. No.: 14/302,346

(22) Filed: Jun. 11, 2014

(65) Prior Publication Data

US 2014/0361025 A1 Dec. 11, 2014

Related U.S. Application Data

(60) Provisional application No. 61/833,895, filed on Jun. 11, 2013.

(51) Int. Cl.

| | |
|---|---|
| ***B65D 25/00*** | (2006.01) |
| ***A47G 23/02*** | (2006.01) |
| ***G09F 7/18*** | (2006.01) |
| ***G09F 7/00*** | (2006.01) |

(52) U.S. Cl.

CPC ..... *G09F 7/00* (2013.01); *A47G 23/0225* (2013.01)

(58) Field of Classification Search

CPC ..... G09F 2007/1869; A47F 7/283; A47G 23/0216; A47G 23/0266

USPC ..... 220/742, 741, 738, 737

See application file for complete search history.

(56) References Cited

U.S. PATENT DOCUMENTS

| | | | | | |
|---|---|---|---|---|---|
| 2,215,402 | A * | 9/1940 | McDonald | 294/33 |
| 2,672,988 | A * | 3/1954 | Johnson | 211/88.01 |
| 3,707,272 | A * | 12/1972 | Rasmussen | 248/311.2 |
| D287,789 | S * | 1/1987 | Johnson | D7/620 |
| 4,838,466 | A * | 6/1989 | Holmstrom | 224/250 |
| 4,865,237 | A * | 9/1989 | Allen | 224/552 |
| 4,872,022 | A * | 10/1989 | Schock | 343/806 |
| 5,052,649 | A * | 10/1991 | Hunnicutt | 248/311.2 |
| 5,361,950 | A * | 11/1994 | Signal et al. | 224/585 |
| 5,421,638 | A * | 6/1995 | Ayotte et al. | 297/188.04 |
| 5,813,644 | A * | 9/1998 | Bergin | 248/311.2 |
| 5,984,136 | A * | 11/1999 | Mason | 220/737 |
| 7,080,753 | B1 * | 7/2006 | Miller | 220/737 |
| D526,538 | S * | 8/2006 | Harris | D7/619.2 |
| 7,156,353 | B2 * | 1/2007 | Kringel et al. | 248/311.2 |
| 7,681,346 | B2 * | 3/2010 | Bruce | 40/324 |
| D660,361 | S * | 5/2012 | Carver, Jr. | D20/19 |
| 8,272,506 | B1 * | 9/2012 | Flannery et al. | 206/217 |
| 8,443,996 | B2 * | 5/2013 | Ciarrocchi, Jr. | 220/23.4 |
| 8,757,573 | B1 * | 6/2014 | Barnes, Jr. | 248/311.2 |
| 8,955,242 | B2 * | 2/2015 | Bruce | 40/324 |
| 2004/0118022 | A1 * | 6/2004 | Duesler | 40/324 |
| 2004/0149765 | A1 * | 8/2004 | Pryce | 220/737 |
| 2005/0050631 | A1 * | 3/2005 | Rifkin | 4/661 |
| 2006/0278650 | A1 * | 12/2006 | Randall | 220/737 |
| 2008/0217207 | A1 * | 9/2008 | Hall | 206/563 |
| 2011/0005953 | A1 * | 1/2011 | Hochhalter et al. | 206/363 |
| 2014/0197187 | A1 * | 7/2014 | Perlmutter | 220/737 |

* cited by examiner

*Primary Examiner* — Fenn Mathew
*Assistant Examiner* — Andrew T Kirsch

(57) ABSTRACT

A display shield assembly adapted to hold a beverage. The display shield assembly construction includes a display shield and a collapsible beverage container frame. The collapsible beverage container frame comprises a substantially circular container stabilizer and a strap. The strap is integrally connected to the substantially circular container stabilizer. The strap includes at least one surface portion that is attached to the display shield. The collapsible beverage container frame supports a beverage container in wedged suspension under the force of gravity.

11 Claims, 10 Drawing Sheets

FIG. 15
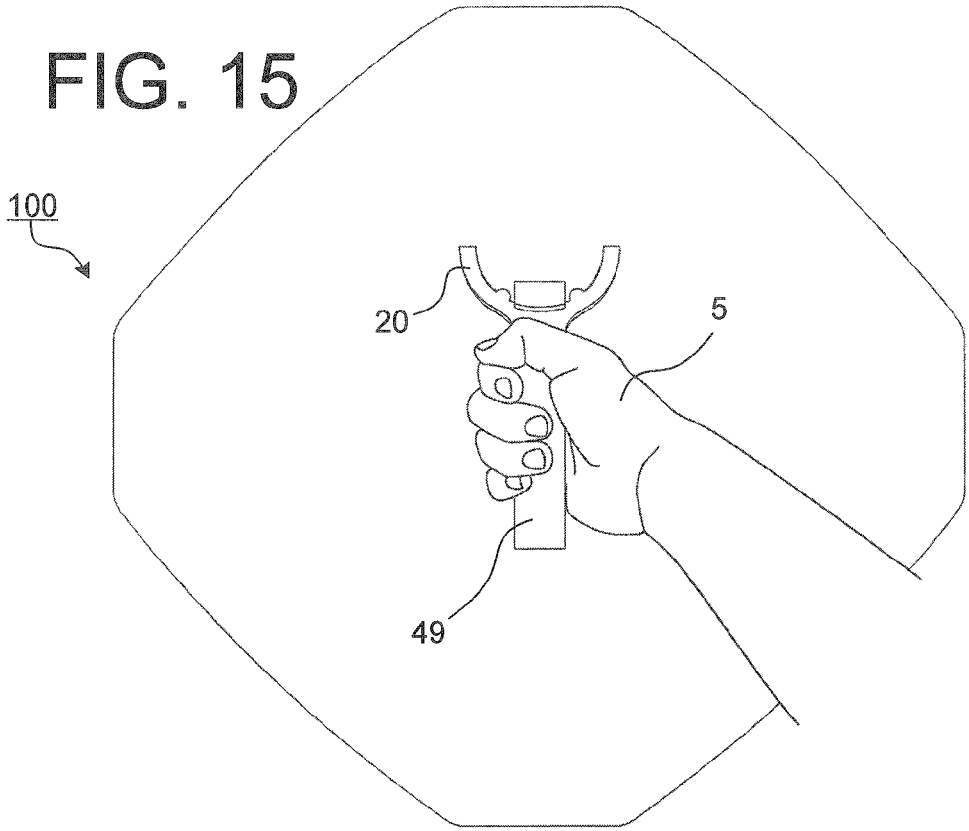
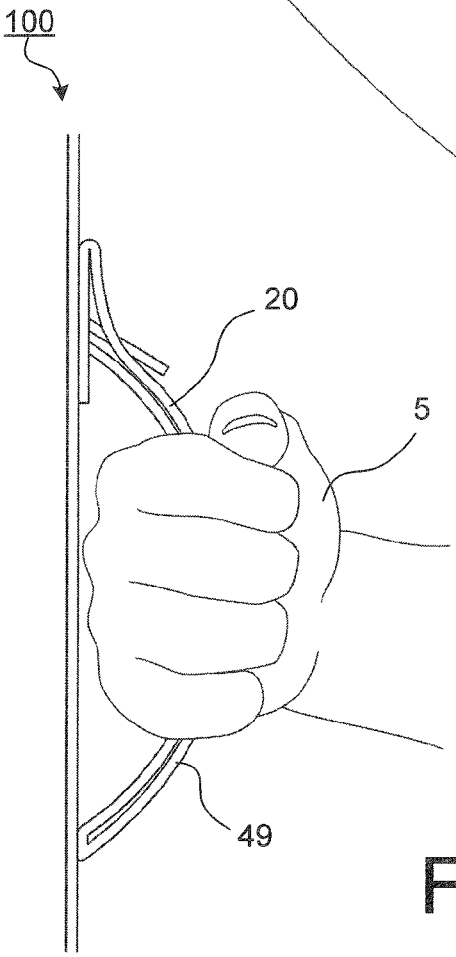
FIG. 16

DISPLAY SHIELD HAVING A COLLAPSIBLE HOLDER FOR A BEVERAGE

CROSS REFERENCE TO RELATED APPLICATION

This application is a Non-Provisional Application which claims the benefit of the filing date of U.S. Provisional Application Ser. No. 61/833,895, filed Jun. 11, 2013, which incorporates by reference all of the subject matter therein.

BACKGROUND

1. Field

This subject disclosure relates generally to a display shield having a holder for cups, cans, bottles or the like, and, more particularly, relates to a collapsible foldable holder for supporting a beverage container while rendering a display shield.

2. Description of the Related Art

Display shields and beverage container are widely known and used for various purposes, separate and apart from each other. As to beverage container holders, various commercially available beverage holding devices are often complex and bulky and require complex mechanical components. Those available that are foldable require complicated components to initiate deployment, securement and/or re-storage. They also require unduly involved user intervention to initiate these functions.

SUMMARY

The following presents a simplified summary of the subject disclosure in order to provide a basic understanding of some aspects thereof. This summary is not an extensive overview of the various embodiments of the subject disclosure. It is intended to neither identify key or critical elements of the subject disclosure nor delineate any scope thereof. The purpose of the subject summary is to present some concepts in a simplified form as a prelude to the more detailed description that is presented hereinafter.

In at least one embodiment, a display shield assembly is provided that is adapted to hold a beverage. The display shield assembly construction includes a display shield and a collapsible beverage container frame. The collapsible beverage container frame comprises a substantially circular container stabilizer and a strap. The strap is integrally connected to the substantially circular container stabilizer. The strap includes at least one surface portion that is attached to the display shield. The collapsible beverage container frame supports a beverage container in wedged suspension under the force of gravity.

These and other objects, features, and/or advantages may accrue from various aspects of embodiments of the present invention, as described in more detail below.

BRIEF DESCRIPTION OF THE DRAWINGS

Various exemplary embodiments of the subject disclosure will be described in detail, wherein like reference numerals refer to identical or similar components or steps, with reference to the following figures, wherein:

FIGS. 15-16 illustrate a user grasping onto the collapsible beverage container frame as a handle absent a beverage container.

DETAILED DESCRIPTION OF EXEMPLARY EMBODIMENTS

Particular embodiments of the present invention will now be described in greater detail with reference to the figures.

Figure 1:
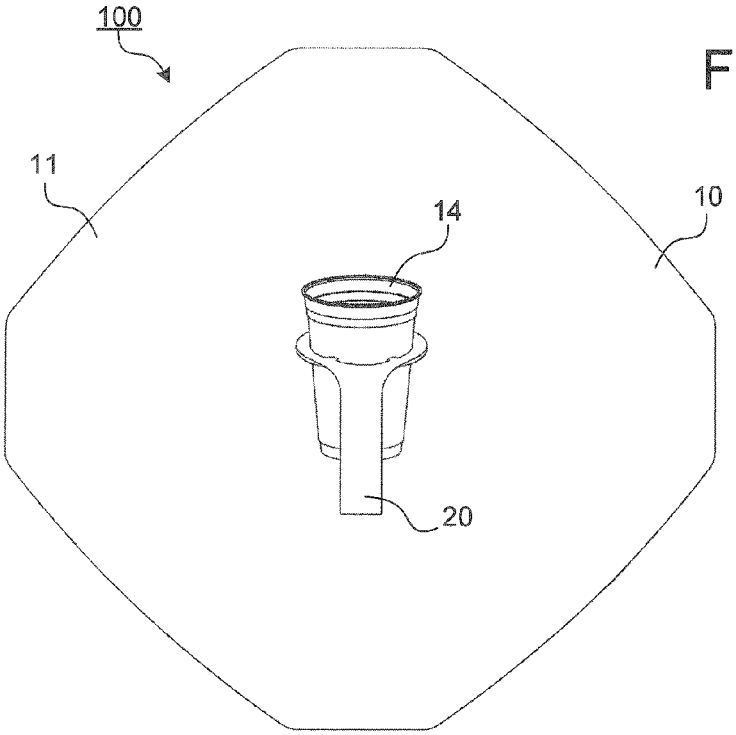
FIG. 1 illustrates an internal side view of an exemplary display shield assembly including a display shield with a collapsible beverage container frame constructed in accordance with aspects of the subject disclosure.
Figure 2:
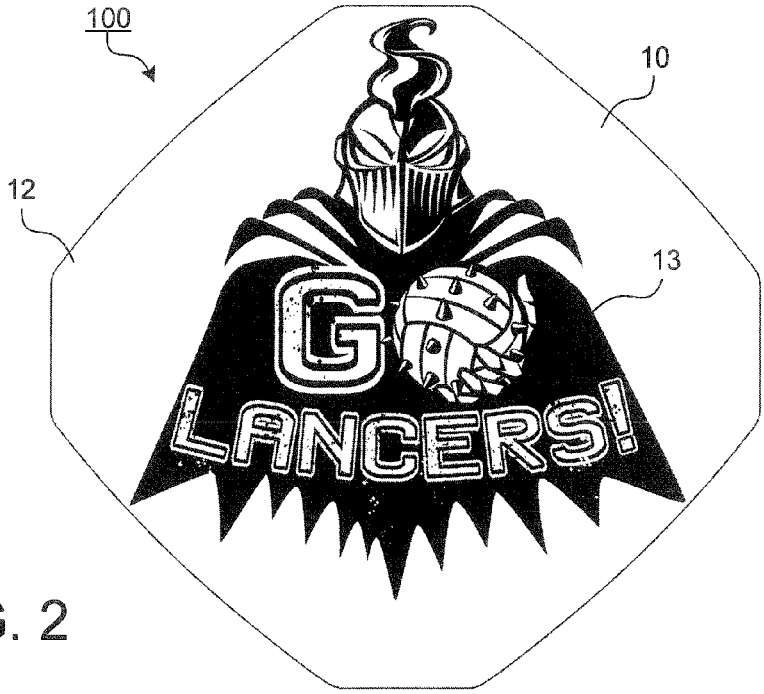
FIG. 2 shows a front side view of the display shield assembly.

FIGS. 1-2 show an exemplary display shield assembly 100. The display shield assembly 100 includes a display shield 10 with a collapsible beverage container frame 20 for securing a beverage container 14. Overall, the display shield assembly 100 can be easily collapsed and put away for storage. Likewise, in use, the display shield assembly 100 can be easily re-deployed open and ready to use as a display shield or to accept a beverage container 14 in the beverage container frame 20.

The display shield assembly 100 is simply constructed, light-weight and compact, and utilizes simple mechanical principles and mechanisms for initiating or furthering deployment. Likewise, when not in use, the storage of the display shield assembly 100 is simple and quick to collapse and store. The display shield assembly 100 is versatile and well suited for use at a sporting event and/or any other place a display banner may be used.

In FIG. 1, the display shield assembly 100 shows a collapsible beverage container frame 20 attached to a rear side 11 of a display shield 10. The beverage container frame 20 may be centrally located in order to best hold the display shield 10 and the beverage 14.

FIG. 2 shows a front side 12 view of the display shield 10 rendering predetermined indicia 13. The display shield 10 may be made in any suitable size or shape according to this subject disclosure. A variety of different types of indicia, such as a logo may be provided on the front side 12 of the display shield 10.

Figure 3:
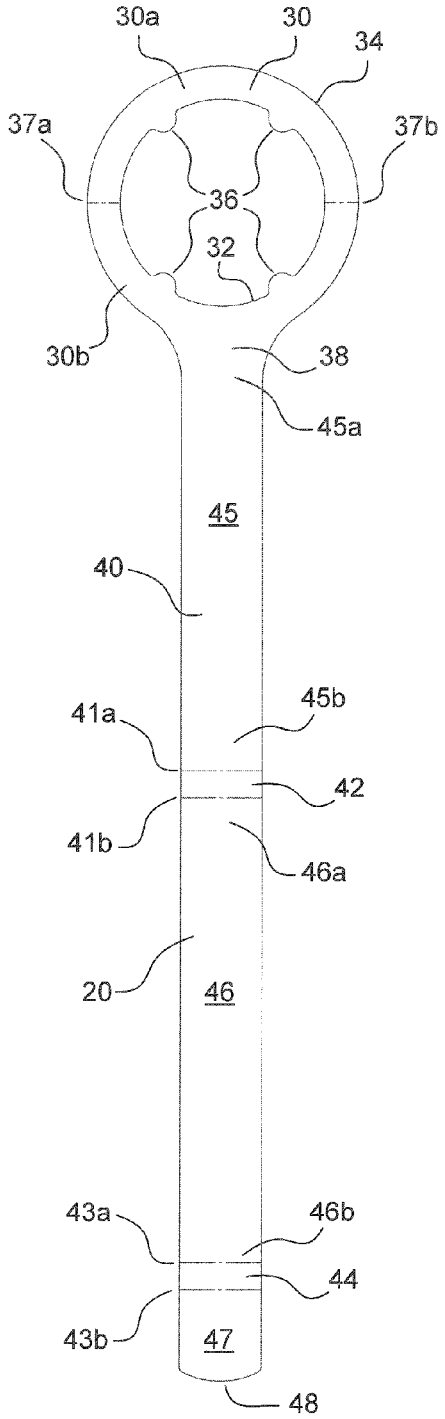
FIG. 3 depicts the collapsible beverage container frame unattached.

FIG. 3 depicts the collapsible beverage container frame 20 in an unattached extended configuration. The collapsible beverage container frame 20 includes a framework defined by a substantially circular container stabilizer 30 and a strap 40 extending from the circular container stabilizer 30.

The container stabilizer 30 is includes an inner circular edge 32 and an outer circular edge 34 defining a predetermined thickness for the container stabilizer 30 sufficient to support a weighted beverage container 14. The container stabilizer 30 has an outer diameter at its outer circular edge 34 that is larger than an inner diameter defining the inner circular edge 32 of the container stabilizer 30.

The container stabilizer 30 may include various tabs 36 projecting inward from the inner circular edge 32 to accommodate the varying sizes and shapes for a beverage container 14 secured therein. As described in more detail later, the tabs 36 also serve to narrow the opening in the container stabilizer 30 to accommodate securing beverage containers 14 of various sizes.

The outer diameter of the outer circular edge 34 merges together at a neck 38 portion. At the neck 38, the container stabilizer 30 and the neck 38 integrally combine into the configuration of a first end 45*a* of the strap 40. The strap 38 extends from the neck 38 to a peripheral end 48, opposite the neck 38.

The container stabilizer 30 may also include a pair of folds 37*a*, 37*b* along the substantially circle configuration of the container stabilizer 30. As will be described later, the folds 37*a*, 37*b* are provided to allow the container stabilizer 30 to conveniently fold over during storage of the container frame 20.

The strap 40 is an elongated flat length defining the shape and size of the strap 40. The strap 40 includes a first pair of folds 41*a*, 41*b*, and a second pair of folds 43*a*, 43*b* adapted to define attachment surfaces 42 and 44 there-between, respectively, upon which the strap 40 can be fastened/attached to the display shield 10.

Figure 4:
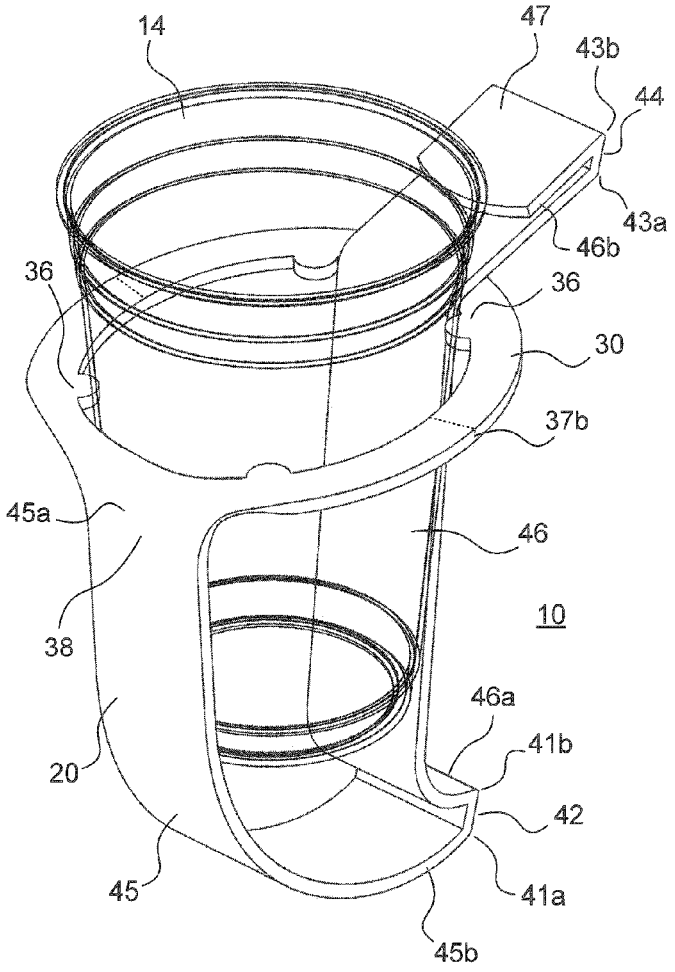
FIG. 4 illustrates a perspective front view of the collapsible beverage container frame holding a beverage.

FIG. 4 shows the attachment surface 42 bounded by the first pair of folds 41*a* and 41*b*. FIG. 4 also shows the attachment surface 44 bounded by the second pair of folds 43*a* and 43*b*. The attachment surface 42 is shown attached at a first lower position to the display shield 10, and the attachment surface 44 is shown attached at a second upper position on the display shield 10. As such, the container frame 20 is aligned substantially vertical to the floor to support a beverage container 14 in an upright position.

Referring back to FIG. 3, the strap 40 includes at least 4 regions surrounding the attachment surfaces 42 and 44. A first region is the substantially circular container stabilizer 30 region that secures and encircles the beverage container 14. A second region extends from the neck 38 to the first attachment surface 42 and defines a forward strap 45 portion. A third region extends from the first attachment surface 42 to the second attachment surface 44 and defines a rearward strap 46 portion. A fourth region extends from the second attachment surface 44 to a peripheral edge 48 of the strap 40 and defines a locking 47 portion.

As shown in FIG. 4, the container stabilizer 30 encircles the beverage container 14 connecting the forward strap 45 and the rearward strap 46 relative to each other. From the neck 38, the forward strap 45 portion has an upper forward strap 45*a* portion that extends from the neck 38 to a lower forward strap 45*b* portion adjacent to the first attachment surface 42. From the first attachment surface 42, a lower rearward strap 46*a* portion of the rearward strap 46 extends to an upper rearward strap 46*b* portion adjacent to the second attachment surface 44. The locking flap 47 extends from the second attachment surface 44 outward from the display shield 10 and extends to the peripheral edge 48 of the strap 40, opposite the neck 38.

Figure 5:
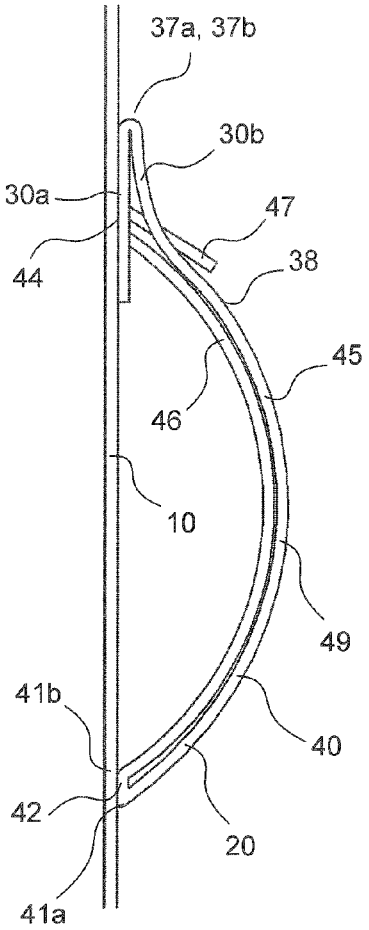
FIGS. 5-6 show side views of the collapsible beverage container frame with, and without a beverage.
Figure 6:
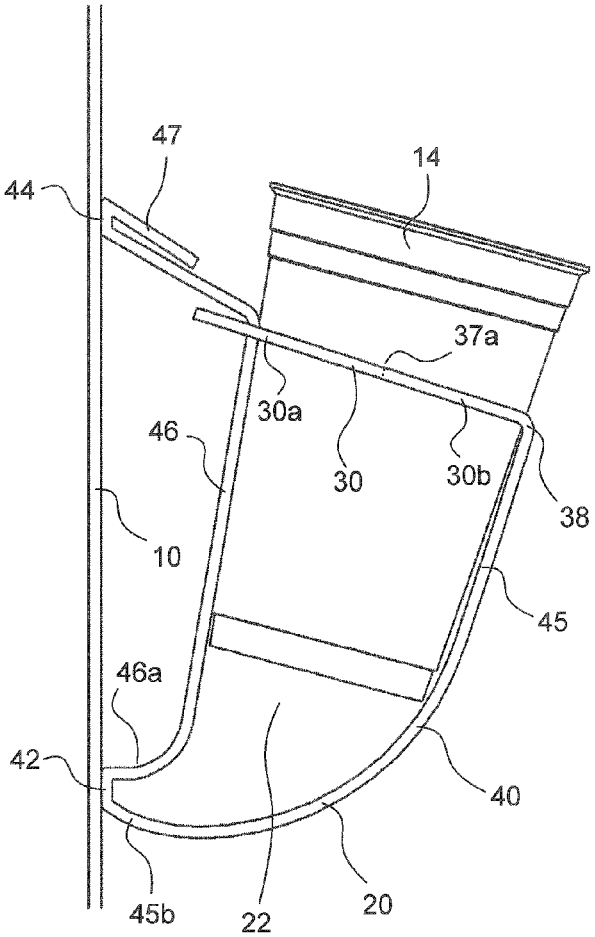

The strap 40 is made of a flexible material and is adapted to be easily bent from a collapsible strap position shown in FIG. 5 into a beverage carrying configuration as shown in FIG. 6. Likewise, the use of the strap 40 is advantages in that it acts as a protective insulator to a user's hand 5 when the beverage and/or beverage container is considerably cold or hot.

In use, the first attachment surface 42 and the second attachment surface 44 are attached the display shield 10. The attachment may be made in any suitable manner, such as by using glue, a bonding agent, a heat weld or any other suitable process for attaching the collapsible beverage container frame 20 to the display shield 10.

FIG. 5 depicts the collapsible beverage container frame 20 in a configuration absent a beverage 14. The first attachment surface 42 and the second attachment surface 44 are shown attached to the display shield 10. In the collapsed configuration, the container stabilizer 30 is shown folded about fold points 37*a*, 37*b* so that an upper half 30*a* of the container stabilizer 30 is able to lay flat against the display shield 10 and a lower half 30*b* of the container stabilizer 30 extends slightly outward away from, and along a length of the display shield 10.

The forward strap 45 and the rearward strap 46 lay adjacent to each other and jut outward away from the display shield 10 from the first attachment surface 42 and the second attachment surface 44 forming a handle 49 that can be grasped by a user to hold the display shield 10. By way of example, FIGS. 15-16 show a user 5 grabbing onto the collapsible beverage container frame 20 as a handle 49 and holding for display purposes.

Figure 7:
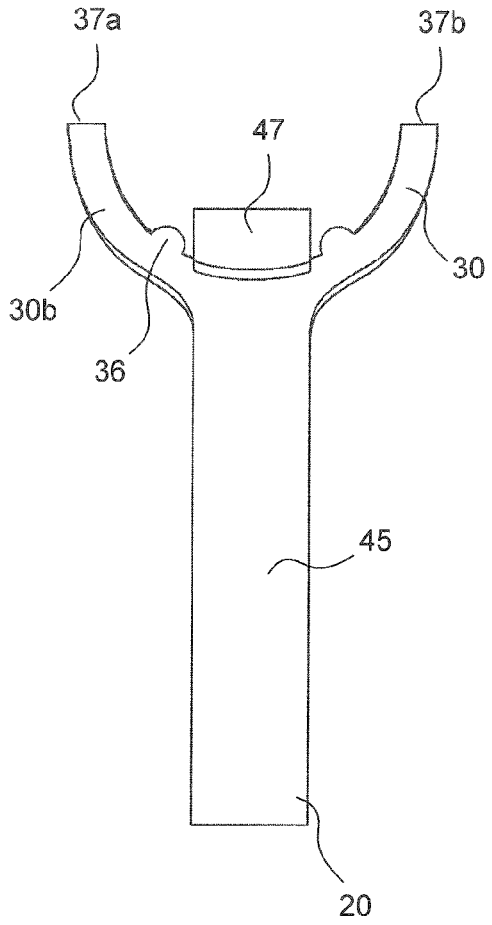
FIGS. 7-8 show front views of the collapsible beverage container frame with, and without a beverage.

As shown in a front view of the collapsible position in FIG. 7, the locking tab 47 of the collapsible beverage container frame 20 extends over the lower half 30*b* of the container stabilizer 30 and secures the forward strap 45 and the rearward strap 46 in a position where they lie adjacent to each other to form the handle 49, as shown in side view in FIG. 5.

FIG. 6 depicts the collapsible beverage container frame 20 in an open position receiving a beverage container 14. As such, the first attachment surface 42 and the second attachment surface 44 are shown attached to the display shield 10 with a weighted beverage 14 contained therein. The container stabilizer 30 in shown unfolded open and receiving the outer circular container portion of the beverage 14.

Disposed within the beverage container frame 20, the beverage container 14 separates the forward strap 45 from the rearward strap 46 and is secured there between. That is, the rearward strap 46 supports the beverage container 14 and is positioned between the beverage container 14 and the display shield 10. The forward strap 45 also provides support to the beverage container 14 and is positioned outside of the beverage container 14 furthest from the display shield 10 as shown in FIG. 6.

Under the force of gravity exerted by the weight of the beverage container 14, the beverage container 14 weighs down on the collapsible beverage container frame 20 causing the beverage container 14 to be cinched or wedged into an upright position (as shown in FIG. 6) within a conical wedge 22 formed by an opening formed between the forward strap 45 and the rearward strap 46. Since the lower ends 46*a*, 45*b* of the forward strap 45 and the rearward strap 46 come together at the second attachment surface 44, the lower end of the forward strap 45 and the rearward strap 46 form the flexible conical pinch or wedge 22 that causes the lower end of the beverage container 14 to stand in the upright position. The material of the strap 40 forming the flexible conical wedge 22 is resilient and adapted to support various beverage containers 14 as shown in FIGS. 17-20.

Figure 13:
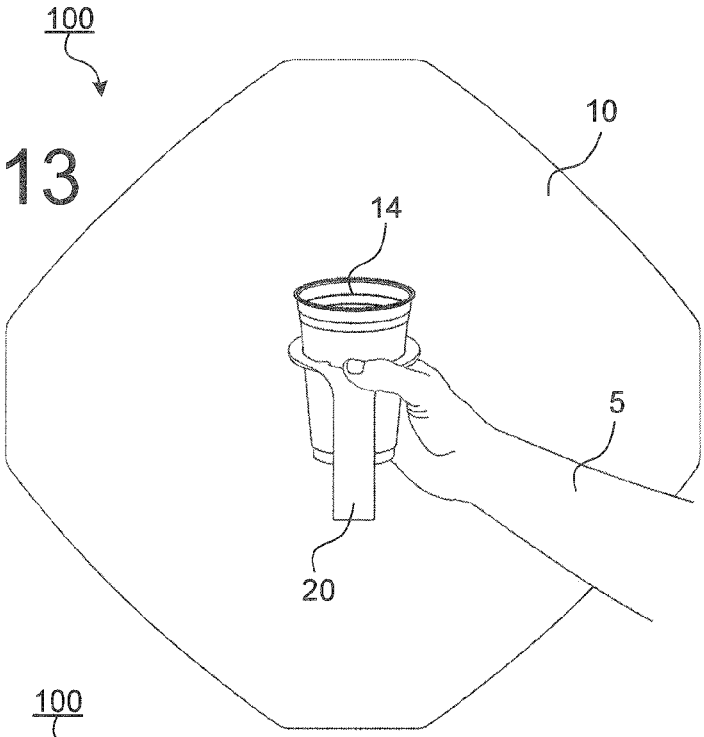
FIGS. 13-14 depict a user grasping onto the collapsible beverage container frame with a beverage container therein.
Figure 14:
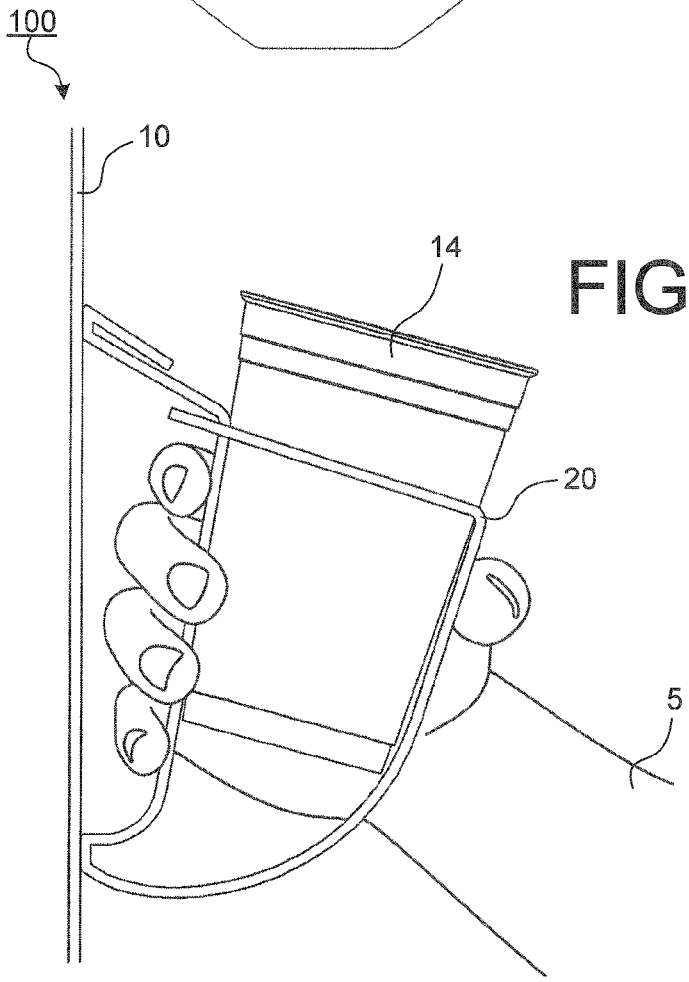
Figure 17:
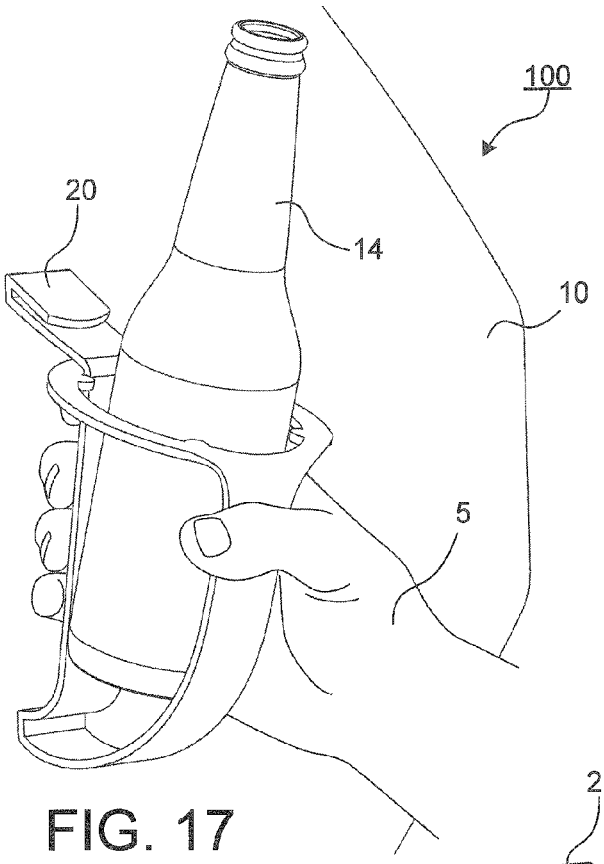
FIGS. 17-20 show various views of a user grasping onto the collapsible beverage container frame adapted for various types of beverage containers provided therein.
Figure 18:
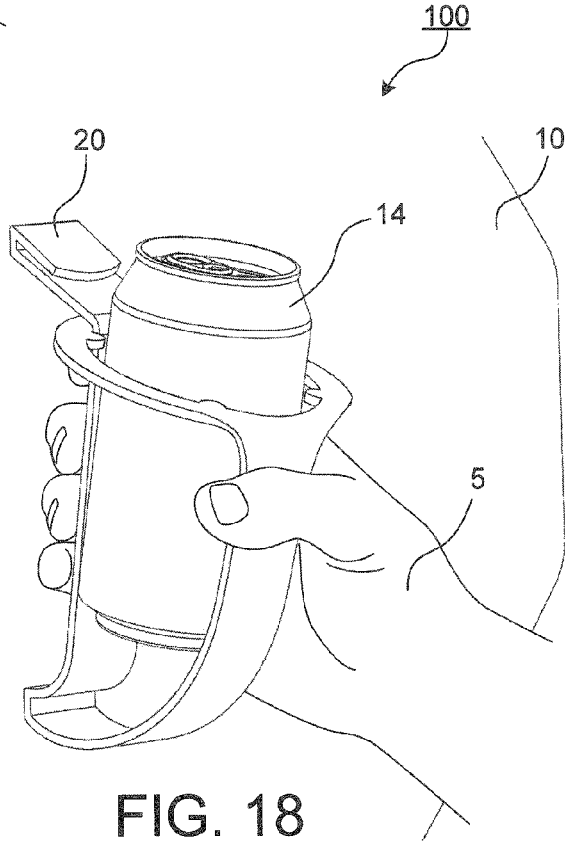
Figure 19:
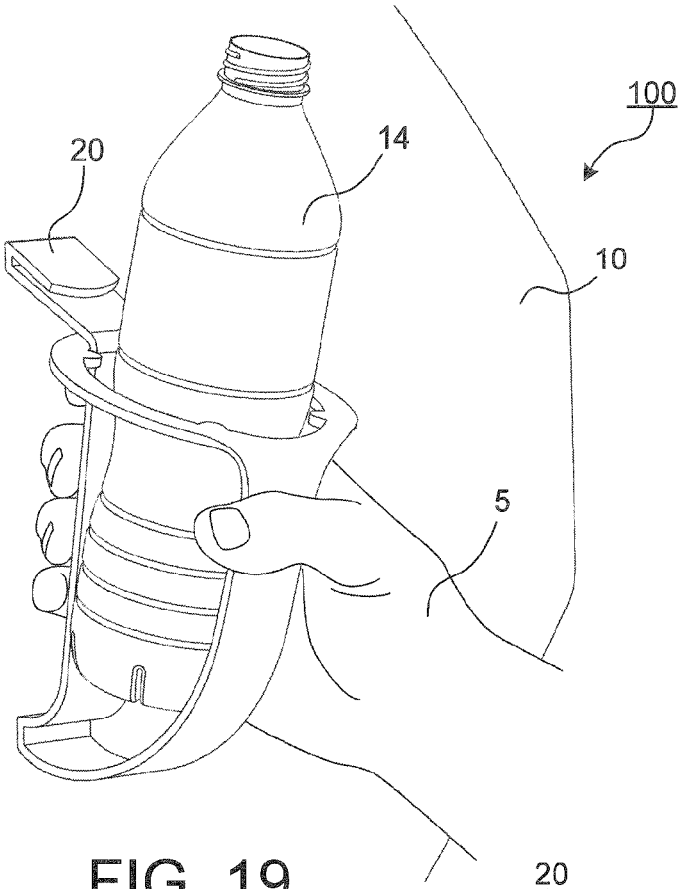
Figure 20:
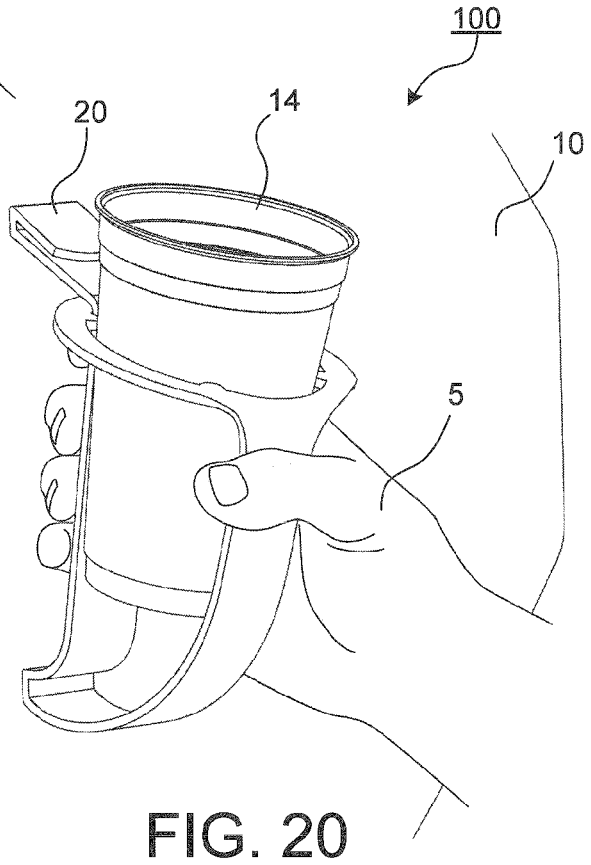

FIGS. 13-14 demonstrate the use of the beverage container frame 20 with a beverage container 14 disposed therein. As shown, the user 5 may grip with their hand 5 around the beverage container frame 20 about the forward strap 45 and the rearward strap 46 and around beverage container 14 to securely stabilize the beverage container 14 within the collapsible beverage container frame 20. As such, the user 5 is able to securely hold their beverage container 14 via the beverage container frame 20 and the display shield 10 with a single hand 5. This is a big advantage over conventional uses in that a user traditionally would have to hold their display sign in one hand and their beverage in a second hand making it substantially difficult to maneuver the display sign and a beverage. Holding additional items traditionally was practically impossible. Conventionally, the required use of both hands to hold a sign and a beverage was impracticable and cumbersome at sporting events and the like. According to this subject disclosure, the display shield 10, the beverage 14 and the beverage container holder 20 can all be held by one hand of the user freeing up the users second hand allowing the user to hold an additional item such as food or the like. It is to be understood that various modifications may be made to the structure and configuration of the display shield 10 and beverage container frame 20 in accordance with this subject disclosure.

Referring back to FIGS. 7-8, the beverage container frame 20 is shown in front view, with and without a beverage container 14 provided therein. In FIG. 7, the beverage container frame 20 is shown collapsed and folded over at the fold points 37*a*, 37*b* with the locking tab 47 disposed over, and thereby captivating, the lower end 30*b* of the container stabilizer 30.

Figure 8:
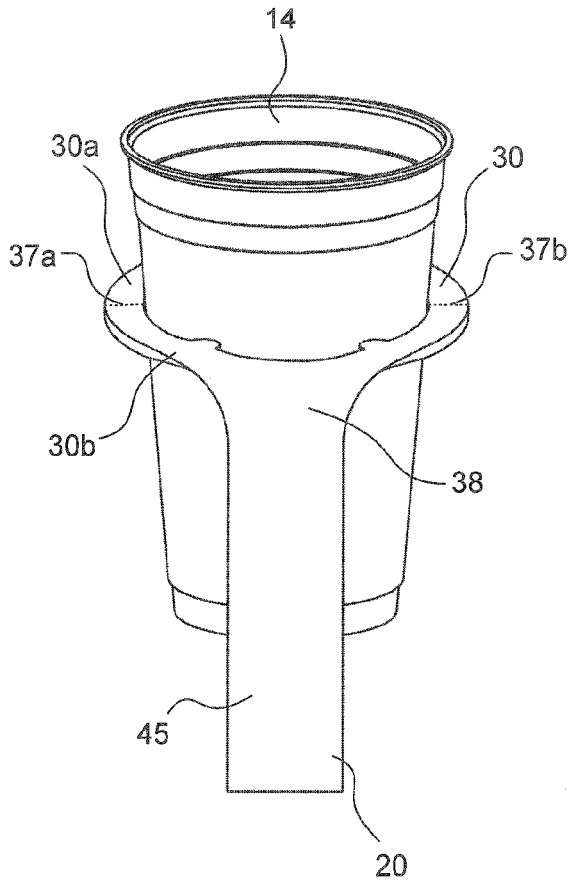

In FIG. 8, the container stabilizer 30 is shown in an open position. In use, the beverage container 14 can be grasped along with the forward strap 45, the rearward strap 46 around the beverage container 14 to securely stabilize the beverage container 14 while insulating the hand of the user 5 from the potentially extreme temperatures of the beverage 14.

Figure 9:
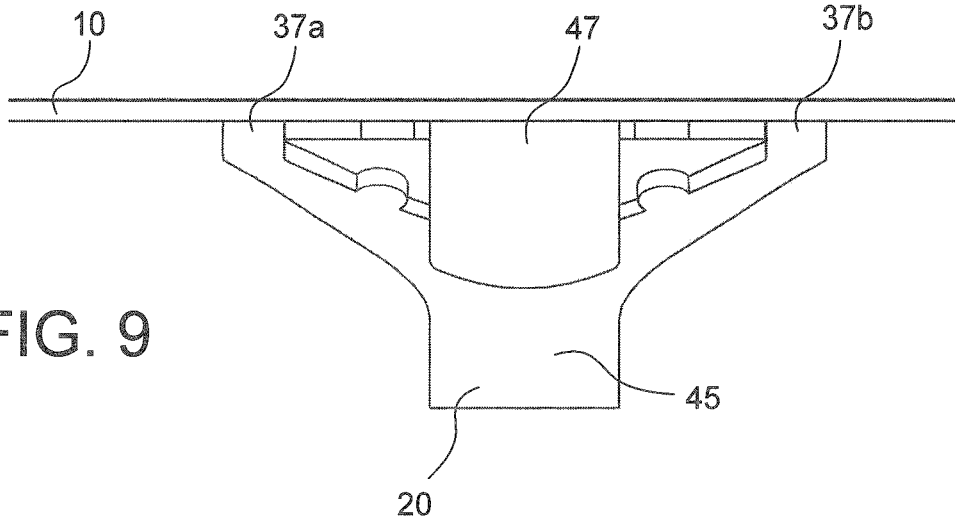
FIGS. 9-10 show top views of the collapsible beverage container frame with, and without a beverage.
Figure 10:
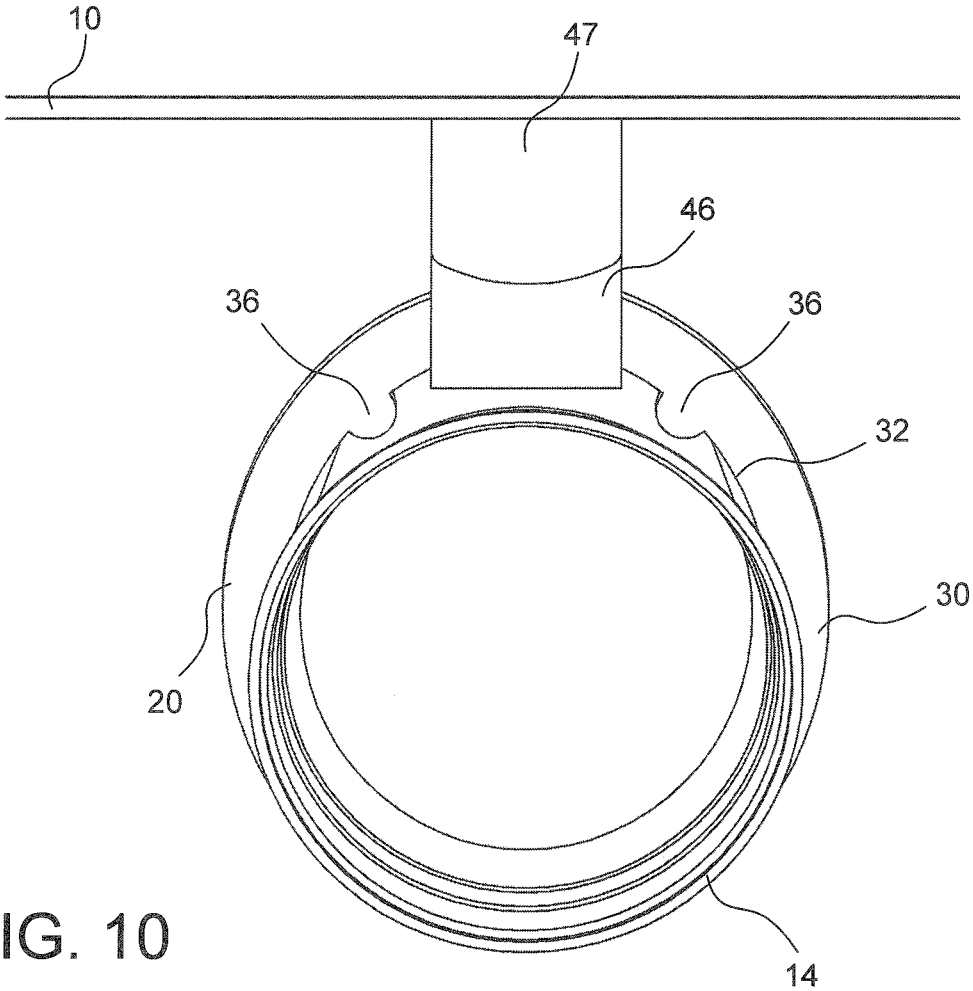

FIGS. 9-10 illustrate a lower view of the collapsible beverage container frame 20, with and without a beverage container 14 disposed therein. As shown in FIG. 10, the various tabs 36 are shown provided on the inside surface 32 of the container stabilizer 30. The tabs 36 are provided to align the container 14 within the inside surface 32 of the inner circle of the container stabilizer 30. Likewise, the tabs 36 also close the inner diameter circle of the inside surface 32 of the container stabilizer 30 to permit various beverage containers 14 of various sizes to be held within the container stabilizer 30, as shown in FIGS. 17-20.

Figure 11:
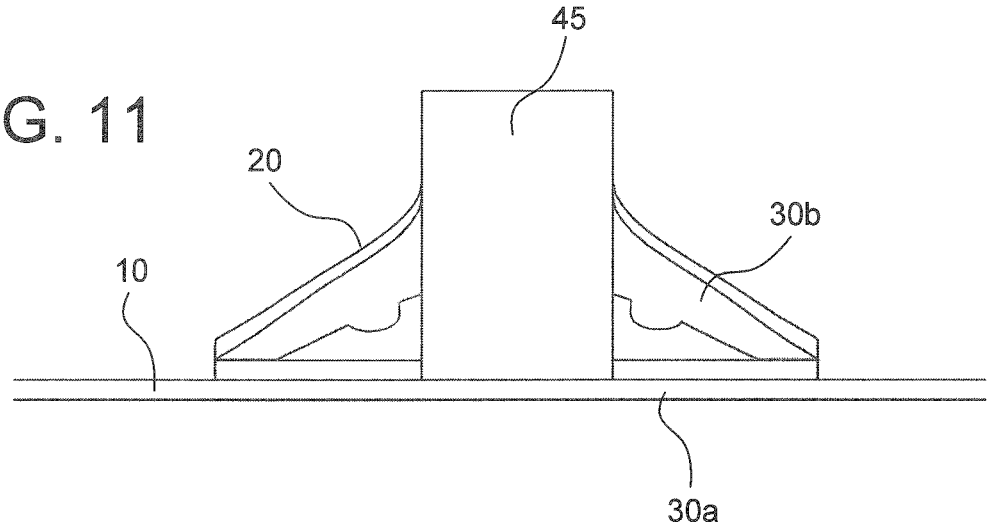
FIGS. 11-12 show bottom views of the collapsible beverage container frame with, and without a beverage.
Figure 12:
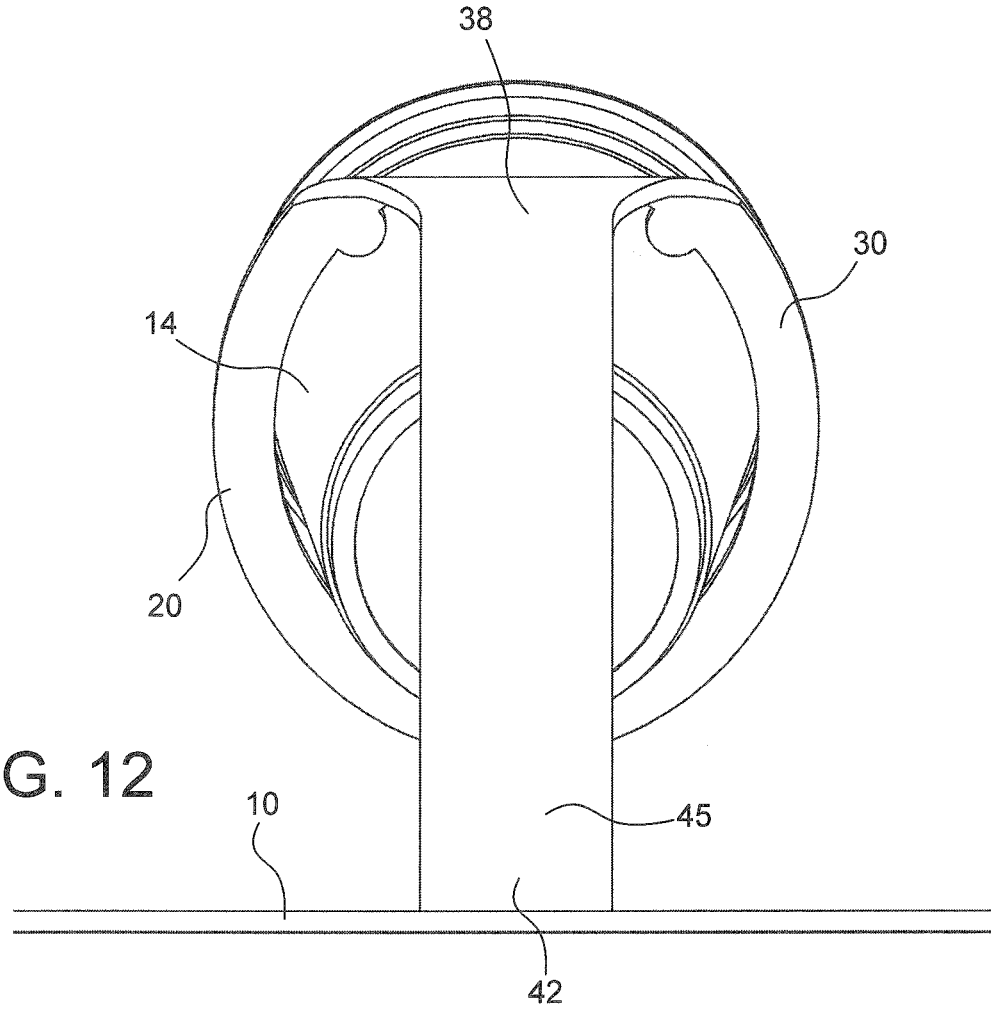

FIGS. 11-12 show the collapsible beverage container frame 20 attached to the display shield 10, with and without a beverage container 14 disposed therein. The collapsible beverage container frame 20 acts as a suspension structure secured at the attachment surfaces 42, 44 into which the beverage container 14 can be secured in suspension by its own weight. The display shield assembly 100 may be adapted for use with various different types of display shields 10 and/or collapsible beverage container frames 20. The various embodiments described and shown herein are not intended to cover all modifications and changes that are also within the scope and spirit of the invention.

It is to be understood that the display shield assembly 100 may be adapted to provide a combined cup and snack holder. The snack holder can be embodied as a collapsible snack tray integrated as part of the display shield 10, also made of for example, cardboard, or a PP/PPE plastic sheet. The snack tray portion may fold out from the main panel of the display shield 10 to allow the carrying of snacks from concession stand to event seating.

The display shield 10 and/or the collapsible beverage container frame 20 may be made of various materials, including but not limited to made of cardboard, corrugated plastic sheet, silicone, polypropylene sheet and/or other suitable material for providing rigidity to carry support a weighted beverage and/or other suitable material for displaying indicia and/or securing the weighted beverage container. Furthermore, the display shield 10 may be an inflatable material capable of being compactly stored during non-use and inflated into a full size display sign during use.

The flexibility of the compressible handle may be adapted to secure various beverage shapes and sizes, such as but not limited to concession stand cups, water bottles, 12 ounce cans, and the like.

The shape and material composition of the display shield 10 or the collapsible beverage container frames 20 may be selected from any variety of durable materials, including, but not limited to: plastic, paper, cardboard, rubber, metal, fabric, and/or any other suitable composition for flexibly displaying a banner and/or holding a beverage container.

The front or rear side of the display shield 10 may be provided with a variety of different indicia, for example, a trademark, a service mark, a name, an emblem, a logo, a banner, an advertisement and/or any other type of indicia. The user can place indicia to support their favorite business, university, school, local establishment, military, hobbies, and/or any other suitable indicia according to this subject disclosure. The indicia may be screen printed thereon and die cut. Likewise, the collapsible beverage container frames 20 may also be provided with indicia.

The display shield 10 may be constructed in a variety of different shapes and sizes, such as but not limited to, circles, rectangles, squares, triangles, trademark designs, logo, brand and mascot outlines, and/or any obtuse shape, design or in accordance with this invention. The display shield 10 or the frame 20 may be selected from a variety of suitable different thicknesses.

The foregoing exemplary descriptions and the illustrative preferred embodiments of the present invention have been explained in the drawings and described in detail, with varying modifications and alternative embodiments being taught. For example, the collapsible beverage container frame 20 may be adapted for use with any object other than the display shield, such as in a car, on a bicycle, a gate, a table, a bench, or any surface suitably connected to the collapsible beverage container frame 20.

While the invention has been so shown, described and illustrated, it should be understood by those skilled in the art that equivalent changes in form and detail may be made therein without departing from the true spirit and scope of the invention, and that the scope of the present invention is to be limited only to the claims except as precluded by the prior art. Moreover, the invention as disclosed herein, may be suitably practiced in the absence of the specific elements which are disclosed herein.

What is claimed is:

1. A display shield assembly, comprising:

a display shield; and a collapsible beverage container frame, comprising:

a container stabilizer having a substantially circular shaper; and a strap integrally connected to the container stabilizer, wherein the strap is attached to the display shield, the collapsible beverage container frame supports a beverage container in wedged suspension under a force of gravity, wherein the container stabilizer includes an inner circular edge and an outer circular edge, and wherein at least one tab projects inward from the inner circular edge of the container stabilizer to secure and accommodate varying beverage container sizes and shapes, wherein the outer circular edge of the container stabilizer merges together at a neck and extends therefrom to define the strap that extends away from the neck to a peripheral end, opposite the neck, wherein, when the collapsible beverage container frame is attached to the display shield, at least four regions are formed:

an encircling strap portion defining the container stabilizer encircling the beverage container;

a forward strap portion defining a second region that extends from the neck to a first attachment surface; and a rearward strap portion defining a third region that extends from the first attachment surface to a second attachment surface; and a locking portion defining a fourth region that extends from the second attachment surface to a peripheral edge of the strap, and wherein when the collapsible beverage container frame is in an unfolded open configuration receiving a beverage container, the forward strap is separated from the rearward strap and connected by the container stabilizer about an outer surface of the beverage container forming a wedged configuration, wherein the force of gravity exerted by a weight of the beverage container weighs down on the container frame causing the beverage container to be cinched into the wedge configuration of the container frame into an upright position.

2. The display shield assembly recited in claim 1, wherein the strap is an elongated flat length of material further including a first pair of folds joints adapted to define the first attachment surface fastened to the display shield.

3. The display shield assembly recited in claim 2, wherein the strap includes a second pair of folds joints adapted to define the second attachment surface fastened to the display shield, wherein the first attachment surface is an upper attachment and the second attachment is a lower attachment.

4. The display shield assembly recited in claim 3, wherein the container stabilizer includes a third pair of folds joints oppositely positioned on the container stabilizer to allow the container stabilizer to fold over.

5. The display shield assembly recited in claim 1, wherein when the container frame is in a collapsed configuration, the container frame is configured as a flat handle with the forward strap and the rearward strap positioned adjacent to each other.

6. A collapsible beverage container holder, comprising:

a beverage container frame, comprising:

a container stabilizer that is substantially circular; and a strap integrally connected to the container stabilizer, the container stabilizer and the strap forms an open pocket into which a beverage container in positioned and wedged in suspension under a force of gravity wherein the container stabilizer includes an inner circular edge and an outer circular edge, and wherein at least one tab projects inward from the inner circular edge of the container stabilizer to secure and accommodate varying beverage container sizes and shapes, wherein the outer circular edge of the container stabilizer merges together at a neck and extends therefrom to define the strap that extends from the neck to a peripheral end, opposite the neck, wherein when the beverage container frame is attached to a display shield, at least the following four regions are formed:

an encircling strap portion defining the container stabilizer encircling the beverage container;

a forward strap portion defines a second region that extends from the neck to a first attachment surface; and a rearward strap portion defines a third region that extends from the first attachment surface to a second attachment surface; and a locking portion defines a fourth region that extends from the second attachment surface to the peripheral end of the strap, and wherein when the beverage container frame is in an unfolded open configuration receiving a beverage container, the forward strap is separated from the rearward strap and connected by the container stabilizer about an outer surface of the beverage container forming a wedged configuration such that when the beverage container is positioned within the wedge configuration of the container frame force of gravity exerted by a weight of the beverage container weighs down on the beverage container frame causing the beverage container to be cinched into the wedge configuration into an upright position.

7. The collapsible beverage container holder recited in claim 6, wherein the strap is an elongated flat length of material further including a first pair of folds joints adapted to define the first attachment surface fastened to the display shield.

8. The collapsible beverage container holder recited in claim 7, wherein the strap includes a second pair of folds joints adapted to define the second attachment surface, wherein the first attachment is an upper attachment and the second attachment is a lower attachment.

9. The collapsible beverage container holder recited in claim 8, wherein the container stabilizer includes a third pair of folds joints oppositely positioned on the container stabilizer to allow the container stabilizer to fold over.

10. The collapsible beverage container holder recited in claim 6, wherein when the container frame is in a collapse configuration, the container frame is a flat handle with the forward strap and the rearward strap positioned adjacent to each other.

11. A display shield assembly, comprising:

a display shield; and a beverage container frame fastened to the display shield, comprising:

a container stabilizer that is substantially circular; and a strap integrally connected to the substantially circular container stabilizer, wherein the strap includes at least one attachment surface that is fastened to the display shield, the beverage container frame supports a beverage container in wedged suspension under a force of gravity, when the beverage container frame is in a collapse configuration, the container frame is a flat handle with the forward strap and the rearward strap positioned adjacent to each other; and when the beverage container frame is in an unfolded open configuration adapted to receive a beverage container, the forward strap is separated from the rearward strap about an outer surface of the beverage container forming a wedged configuration such that when the beverage container is positioned within the wedge configuration, a force of gravity exerted by a weight of the beverage container weighs down on the beverage container frame causing the beverage container to securely cinch the beverage container into an upright position.

* * * * *